US011643784B2

(12) United States Patent
Zhao

(10) Patent No.: US 11,643,784 B2
(45) Date of Patent: May 9, 2023

(54) BARRIER GATE

(71) Applicant: Shenzhen Wins Electronic Technology Co., Ltd., Guangdong (CN)

(72) Inventor: Shengfei Zhao, Guangdong (CN)

(73) Assignee: SHENZHEN WINS ELECTRONIC TECHNOLOGY CO., LTD, Guangdong (CN)

( * ) Notice: Subject to any disclaimer, the term of this patent is extended or adjusted under 35 U.S.C. 154(b) by 0 days.

(21) Appl. No.: 17/507,914

(22) Filed: Oct. 22, 2021

(65) Prior Publication Data

US 2022/0412025 A1 Dec. 29, 2022

(30) Foreign Application Priority Data

Jun. 24, 2021 (CN) ..... 202121410345.6

(51) Int. Cl.
*E01F 13/06* (2006.01)

(52) U.S. Cl.
CPC ..... *E01F 13/06* (2013.01)

(58) Field of Classification Search
CPC ..... E01F 13/06
USPC ..... 49/49, 9; 404/6, 9, 10
See application file for complete search history.

(56) References Cited

U.S. PATENT DOCUMENTS 1,403,698 A * 5/1889 Donovan ..... G09F 21/02 40/586
1,332,237 A * 3/1920 Strauss ..... B61L 29/02 49/73.1
1,403,750 A * 1/1922 Donovan ..... B63B 17/04 188/32
1,536,360 A * 5/1925 Stewart ..... B61L 29/224 49/324
5,318,258 A * 6/1994 Lang ..... G09F 15/0062 40/610
5,482,398 A * 1/1996 Finke ..... E01F 13/02 116/63 P
5,671,563 A * 9/1997 Marcum ..... E01F 13/06 404/10
6,189,839 B1 * 2/2001 Lemieux ..... E01F 9/696 246/127

(Continued)

*Primary Examiner* — Jerry E Redman
(74) *Attorney, Agent, or Firm* — Horizon IP Pte Ltd.

(57) ABSTRACT

The present disclosure relates to the technical field of barrier gates, and discloses a barrier gate, which includes: a barrier gate body located on a road surface; a barrier gate rod arranged on the barrier gate body and rotatably connected with the barrier gate body for restricting the entry and exit of road vehicles; a holding-pole fixing device arranged on one side of the barrier gate body, and used to stably place the barrier gate body on the road surface; a connecting member, wherein one end of the connecting member is connected to the barrier gate body, and the other end is detachably connected to the holding-pole fixing device; the barrier gate body is used for controlling the up and down state of the barrier gate rod according to a control signal. The holding-pole fixing device is used for fixing and mounting, and the barrier gate body is fixedly placed on the road surface through the connection of the connecting member, without mounting the foundation, which is convenient and free from construction and thus saves labor costs.

10 Claims, 1 Drawing Sheet

(56) References Cited

U.S. PATENT DOCUMENTS 6,212,825 B1 * 4/2001 Hopkins, Jr. ..... E01F 13/06 49/358
6,487,818 B1 * 12/2002 Hamann ..... E01F 9/20 49/13
6,655,090 B2 * 12/2003 Regner ..... E06B 11/04 49/386
7,258,461 B1 * 8/2007 Izardel ..... E01F 13/04 362/183
7,384,017 B1 * 6/2008 Burke ..... B61L 29/04 246/127
7,441,983 B2 * 10/2008 Gelfand ..... E01F 13/12 49/34
7,604,289 B2 * 10/2009 Chen ..... A47B 3/14 108/127
8,181,392 B1 * 5/2012 Farber ..... E01F 13/06 49/234
8,240,947 B2 * 8/2012 Gelfand ..... E01F 13/12 49/34
9,388,547 B2 * 7/2016 Kellner ..... E04H 12/2215
10,900,180 B2 * 1/2021 McO'Neil ..... E01F 9/646
11,214,934 B2 * 1/2022 Matthews ..... E01F 13/12
2003/0029067 A1 * 2/2003 Dorstewitz ..... G09F 7/18 40/610
2007/0101649 A1 * 5/2007 Anderson ..... E01F 13/048 49/49
2007/0160421 A1 * 7/2007 Gelfand ..... E01F 13/12 404/6
2010/0192464 A1 * 8/2010 Hirai ..... G09B 19/167 49/9
2011/0215206 A1 * 9/2011 Conrad ..... F16M 11/04 248/170
2012/0204456 A1 * 8/2012 Dobson ..... G09F 15/0062 40/610

* cited by examiner

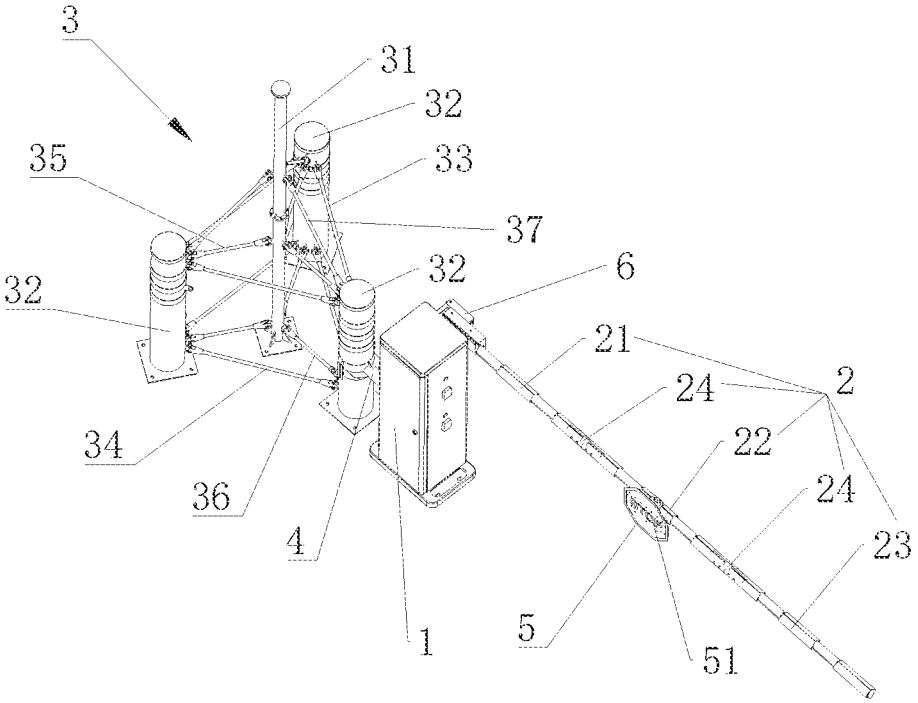
3
31
32
35
33
37
32
6
32
21
2
24
22
34
24
36
23
4
5
1
51

BARRIER GATE

TECHNICAL FIELD

The present disclosure relates to the technical field of barrier gates, and more particularly, to a barrier gate.

BACKGROUND

The barrier gate, also known as the car stop, is a channel entrance and exit management device specially used for restricting motor vehicles on the road, it is now widely used in highway toll stations and parking lot systems to manage vehicle channels and manage the exit and entry of vehicles.

The electric barrier gate can realize the up and down of the rod through wireless remote control alone, or it can be automatically managed through the parking lot management system (i.e. IC card management system), and the card is taken to release the vehicle when entering the venue, and the vehicle will be automatically released after the parking fee is charged when leaving the venue. The existing barrier gates need to be constructed, mounted on the foundation, and thus is not convenient to move after mounting.

Therefore, how to provide a barrier gate to avoid construction has become a technical problem to be addressed urgently.

SUMMARY

The technical problem to be addressed by the present disclosure is how to provide a barrier gate to facilitate the avoidance of construction.

For this purpose, according to a first aspect, an embodiment of the present disclosure discloses a barrier gate, which includes: a barrier gate body located on a road surface; a barrier gate rod arranged on the barrier gate body and rotatably connected with the barrier gate body for restricting the entry and exit of road vehicles; a holding-pole fixing device arranged on one side of the barrier gate body, and used to stably place the barrier gate body on the road surface; a connecting member, wherein one end of the connecting member is connected to the barrier gate body, and the other end is detachably connected to the holding-pole fixing device; the barrier gate body is used for controlling the up and down state of the barrier gate rod according to a control signal.

According to a further embodiment of the present disclosure, the barrier gate rod is provided with a warning board for warning road vehicles, and the warning board is provided with a warning sign for warning.

According to a further embodiment of the present disclosure, the warning board is provided with a luminous lamp for providing light to the warning sign.

According to a further embodiment of the present disclosure, a wire protection frame is mounted on the barrier gate body.

According to a further embodiment of the present disclosure, the barrier gate rod comprises a first rod, a second rod and a third rod that are sleeved in sequence, both ends of the second rod are sleeved with collars, the first rod and the second rod are fixedly connected by bolts, and the second rod and the third rod are fixedly connected by bolts.

According to a further embodiment of the present disclosure, the holding-pole fixing device comprises a positioning rod located on the ground and used to facilitate connecting an external equipment, three fixing rods are arranged in a circumferential direction of the positioning rod, and a first connecting rod and a second connecting rod are arranged between the three fixing rods.

According to a further embodiment of the present disclosure, the holding-pole fixing device further comprises a third fastening rod, one end of the third fastening rod is hinged with the positioning rod, and the other end of the third fastening rod is hinged with the fixing rod.

According to a further embodiment of the present disclosure, the first connecting rod and the second connecting rod are respectively hinged to the fixing rod, one end of the first fastening rod is hinged with the fixing rod, and the other end of the first fastening rod is hinged with the positioning rod, one end of the second fastening rod is hinged with the fixing rod, and the other end of the second fastening rod is hinged with the positioning rod.

The present disclosure has the following beneficial effects: the holding-pole fixing device is used for fixing and mounting, and the barrier gate body is fixedly placed on the road surface through the connection of the connecting member, without mounting the foundation, thereby being convenient and free from construction and saving labor costs.

BRIEF DESCRIPTION OF DRAWINGS

In order to more clearly illustrate the specific embodiments of the present disclosure or the technical solutions in the existing technology, the following will briefly describe the drawings that need to be used in the specific embodiments or the description of the existing technology. Apparently, the drawings in the following description are some embodiments of the present disclosure, for those of ordinary skill in the art, other drawings can be obtained based on these drawings without creative work.

FIG. 1 is a schematic diagram of a three-dimensional structure of a barrier gate disclosed in this embodiment.

REFERENCE NUMERALS

1. barrier gate body; 2. barrier gate rod; 21. first rod; 22. second rod; 23. third rod; 24. collar; 3. holding-pole fixing device; 31. positioning rod; 32. fixing rod; 33. first connecting rod; 34. second connecting rod; 35. first fastening rod; 36. second fastening rod; 37. third fastening rod; 4. connecting member; 5. warning board; 51. warning sign; 6. protection frame.

DETAILED DESCRIPTION

In order to make the objectives, technical solutions, and advantages of the present disclosure clearer, the following further describes the present disclosure in detail with reference to the accompanying drawings and embodiments. It should be understood that the specific embodiments described herein are only used to explain the present disclosure, but not used to limit the present disclosure.

In the description of the present disclosure, it should be noted that, unless otherwise clearly specified and limited, the terms "mounted", "connected with", and "connected to" should be understood in a broad sense, for example, it can be a fixed connection, a detachable connection, or an integral connection; it can be a mechanical connection or an electrical connection; it can be a direct connection, or indirect connection through an intermediate medium, or it can be the internal connection between two components, which can also be a wireless connection or a wired connection. For those of ordinary skill in the art, the specific meanings of the above-mentioned terms in the present disclosure can be understood in specific situations.

In the description of the present disclosure, it should be noted that the orientation or positional relationship indicated by the terms "center", "upper", "lower", "left", "right", "vertical", "horizontal", "inner", "outer", etc. are based on the orientation or positional relationship shown in the drawings, it is only for the convenience of describing the present disclosure and simplifying the description, rather than indicating or implying that the device or element referred to must have a specific orientation, be configured and operated in a specific orientation, and therefore cannot be understood as a limitation to the present disclosure. In addition, the terms "first", "second", and "third" are only used for descriptive purposes, and cannot be understood as indicating or implying relative importance.

In addition, the technical features involved in the different embodiments of the present disclosure described below can be combined with each other as long as they do not conflict with each other.

A barrier gate is disclosed in the present disclosure, as shown in FIG. 1, which includes: a barrier gate body 1, a barrier gate rod 2, a holding-pole fixing device 3 and a connecting member 4, the barrier gate body 1 is located on a road surface; the barrier gate rod 2 is arranged on the barrier gate body 1 and is rotatably connected with the barrier gate body 1, for restricting the entry and exit of road vehicles; the holding-pole fixing device 3 is arranged on one side of the barrier gate body 1, and is used to stably place the barrier gate body 1 on the road surface; one end of the connecting member 4 is connected to the barrier gate body 1, and the other end is detachably connected to the holding-pole fixing device 3; the barrier gate body 1 is used for controlling the up and down state of the barrier gate rod 2 according to a control signal.

It should be noted that the holding-pole fixing device 3 is used for fixing and mounting, and the barrier gate body 1 is fixedly placed on the road surface through the connection of the connecting member 4, without mounting an extra foundation, thereby being convenient and free from construction and saving labor costs.

As shown in FIG. 1, the barrier gate rod 2 is provided with a warning board 5 for warning road vehicles, and the warning board 5 is provided with a warning sign 51 for warning. In a specific process, the warning sign 51 can be "停" or "STOP".

As shown in FIG. 1, the warning board 5 is provided with a luminous lamp for providing light to the warning sign 51. In a specific implementation process, the warning sign 5 can be illuminated by the luminous lamp at night to facilitate warning of vehicles on the road.

As shown in FIG. 1, a wire protection frame 6 is mounted on the barrier gate body 1.

As shown in FIG. 1, the barrier gate rod 2 comprises a first rod 21, a second rod 22 and a third rod 23 that are sleeved in sequence, both ends of the second rod 22 are sleeved with collars 24, the first rod 21 and the second rod 22 are fixedly connected by bolts, and the second rod 22 and the third rod 23 are fixedly connected by bolts. In a specific implementation process, the barrier gate rod 2 is composed of three-section rods, which can be disassembled and assembled for convenient transportation. In addition, the connecting line of the warning board 5 is connected to the barrier gate rod 2 through an aviation plug, and the barrier gate rod 2 passes through the wire protection frame 6 and then enters the barrier gate body 1. The function of the wire protection frame 6 is that when the barrier gate rod 2 rotates 90 degrees and moves back and forth, it will not cause damage to the wire.

As shown in FIG. 1, the holding-pole fixing device 3 comprises a positioning rod 31 located on the ground and used to facilitate connecting an external equipment, three fixing rods 32 are arranged in a circumferential direction of the positioning rod 31, and a first connecting rod 33 and a second connecting rod 34 are arranged between the three fixing rods 32, the positioning rod 31 is provided with a first fastening rod 35 tightly matched with the first connecting rod 33, and the positioning rod 31 is provided with a second fastening rod 36 tightly matched with the second connecting rod 34. In a specific implementation process, the numbers of the first connecting rod 33, the second connecting rod 34, the first fastening rod 35 and the second fastening rod 36 are all set to three. The fixing rod 32 may be a hollow rod, and the fixing rod 32 is filled with sand to increase its weight.

As shown in FIG. 1, the holding-pole fixing device 3 further comprises a third fastening rod 37, one end of the third fastening rod 37 is hinged with the positioning rod 31, and the other end of the third fastening rod 37 is hinged with the fixing rod 32. In a specific implementation process, the number of the third fastening rod 37 is set to three.

As shown in FIG. 1, the first connecting rod 33 and the second connecting rod 34 are respectively hinged to the fixing rod 32, one end of the first fastening rod 35 is hinged with the fixing rod 32, and the other end of the first fastening rod 35 is hinged with the positioning rod 31, one end of the second fastening rod 36 is hinged with the fixing rod 32, and the other end of the second fastening rod 36 is hinged with the positioning rod 31.

Operating principle: the holding-pole fixing device 3 is used for fixing and mounting, and the barrier gate body 1 is fixedly placed on the road surface through the connection of the connecting member 4, without mounting an extra foundation, thereby being convenient and free from construction and saving labor costs; external equipment can be mounted on the positioning rod 31, which is convenient to improve the applicability of the barrier gate and realize multi-functions.

Apparently, the foregoing embodiments are merely examples for clear description, and are not intended to limit the implementation manners. For those of ordinary skill in the art, other changes or modifications in different forms can be made on the basis of the above description. It is not necessary and impossible to list all the implementation methods here. The apparent changes or modifications derived from this are still within the protection scope of the present disclosure.

What is claimed is:

1. A barrier gate, comprising:

a barrier gate body located on a road surface;

a barrier gate rod arranged on the barrier gate body and rotatably connected with the barrier gate body for restricting the entry and exit of road vehicles;

a holding-pole fixing device, wherein the holding-pole device comprises a positioning rod fixed to the ground, a barrier fixing unit disposed on the road surface between the positioning rod and one side of the barrier gate body, wherein the barrier fixing unit is fixedly placed on the road surface by connecting rods connecting the barrier fixing unit to the positioning rod, the barrier fixing unit is used to stably place the barrier gate body on the road surface without requiring an additional foundation;

a connecting member, wherein one end of the connecting member is connected to the barrier gate body, and the other end is detachably connected to the holding-pole barrier fixing unit; and wherein, the barrier gate body is used for controlling the up and down state of the barrier gate rod according to a control signal.

2. The barrier gate of claim 1, wherein the barrier gate rod is provided with a warning board for warning road vehicles, and the warning board is provided with a warning sign for warning.

3. The barrier gate of claim 2, wherein the warning board is provided with a luminous lamp for providing light to the warning sign.

4. The barrier gate of claim 1 wherein, a wire protection frame is mounted on the barrier gate body.

5. The barrier gate of claim 1, wherein the barrier gate rod comprises:

a first rod;

a second rod; and a third rod; and wherein the first, second and third rods are separate rods and are sleeved in sequence, both ends of the second rod are sleeved with collars, the first rod and the second rod are removably fixed together, and the second rod and the third rod are removably fixed together.

6. The barrier gate of claim 1, wherein the barrier fixing unit comprises:

fixing rods, the fixing rods are interconnected by interconnecting rods; and fastening rods for fixing positions of the fixing rods to the positioning rod.

7. The barrier gate of claim 6, wherein the fixing rods are configured in a circumferential arrangement.

8. The barrier gate of claim 7, wherein the positioning rod is disposed at about a center of the circumferentially arranged fixing rods.

9. The barrier gate of claim 6, wherein the fixing rods comprise hollow fixing rods filled with sand to increase weight of the fixing rods.

10. The barrier gate of claim 1, wherein the barrier fixing unit comprises:

first, second and third fixing rods configured in a circumferential arrangement;

first, second and third interconnecting rods configured to interconnect the first, second and third fixing rods;

first, second and third fastening rods are configured to connect the to connect the first, second and third fixing rods to the position rod and maintain the positions of the first, second and third fixing rods fixing rods, the fixing rods are interconnected by interconnecting fixing rods; and fastening rods for fixing positions of the fixing rods to the positioning rod.

* * * * *